US009597875B2

(12) United States Patent
Aoyama et al.

(10) Patent No.: US 9,597,875 B2
(45) Date of Patent: Mar. 21, 2017

(54) PRINTING APPARATUS AND METHOD FOR CONTROLLING PRINTING APPARATUS

(71) Applicant: CANON KABUSHIKI KAISHA, Tokyo (JP)

(72) Inventors: Naoki Aoyama, Tokyo (JP); Toshiyuki Kuroda, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/446,523

(22) Filed: Jul. 30, 2014

(65) Prior Publication Data

US 2015/0049138 A1 Feb. 19, 2015

(30) Foreign Application Priority Data

Aug. 13, 2013 (JP) ..... 2013-168321

(51) Int. Cl.

| | |
|---|---|
| ***B41J 2/165*** | (2006.01) |
| ***B41J 23/02*** | (2006.01) |
| ***B41J 29/13*** | (2006.01) |
| ***B41J 29/38*** | (2006.01) |
| *B41J 13/03* | (2006.01) |

(52) U.S. Cl.

CPC ..... *B41J 2/165* (2013.01); *B41J 23/025* (2013.01); *B41J 29/13* (2013.01); *B41J 29/38* (2013.01); *B41J 13/03* (2013.01)

(58) Field of Classification Search

CPC .. B41J 2/1652; B41J 2/16508; B41J 2/16511; B41J 2/16523; B41J 2/16532; B41J 2/16538; B41J 2/16535; B41J 2/16547

USPC ..... 347/22–23, 29–30, 32–33

See application file for complete search history.

(56) References Cited

U.S. PATENT DOCUMENTS

| | | | | |
|---|---|---|---|---|
| 7,976,020 | B2 | 7/2011 | Awai | |
| 8,235,493 | B2 * | 8/2012 | Horade | B41J 2/16532 347/16 |
| 2003/0063177 | A1 * | 4/2003 | Yoshimura et al. | 347/108 |
| 2005/0068364 | A1 * | 3/2005 | Kayanaka | 347/23 |
| 2010/0207991 | A1 * | 8/2010 | Koizumi | 347/32 |
| 2012/0194605 | A1 * | 8/2012 | Tamaki et al. | 347/22 |
| 2012/0218348 | A1 * | 8/2012 | Okamoto et al. | 347/36 |

FOREIGN PATENT DOCUMENTS

| | | |
|---|---|---|
| JP | 2010-006608 A | 1/2010 |

* cited by examiner

*Primary Examiner* — Jannelle M Lebron
*Assistant Examiner* — Jeremy Bishop
(74) *Attorney, Agent, or Firm* — Fitzpatrick, Cella, Harper & Scinto

(57) ABSTRACT

A needed job is quickly performed even if a recovery operation for a print head performed by a recovery mechanism needs a long time as a result of sharing of the same drive source between a discharge roller and the recovery mechanism. To achieve this, a recovery operation for the print head is suspended when a print job is received while the recovery operation is being performed, on a condition that a printing apparatus is in a state where the printing apparatus permits the print job to be performed.

7 Claims, 14 Drawing Sheets

PRINTING APPARATUS AND METHOD FOR CONTROLLING PRINTING APPARATUS

BACKGROUND OF THE INVENTION

Field of the Invention

The present invention relates to a printing apparatus with a movable tray configured to hold sheets with images printed thereon, and a method for controlling the printing apparatus.

Description of the Related Art

In a printing apparatus, sheets with images printed thereon are discharged into a discharge tray (tray), in which the sheets are held. A movable tray is configured to be able to be opened and closed around a rotatably moving shaft. While out of use, the discharge tray remains closed making the printing apparatus compact and preventing dust and the like from entering a printing section inside the printing apparatus.

Japanese Patent Laid-Open No. 2010-6608 proposes an apparatus that automatically opens the discharge tray utilizing the rotating force of a discharge roller configured to discharge sheets with images printed thereon onto the discharge tray. Specifically, the apparatus includes a delay mechanism that transmits rotation of the discharge roller in a first direction to the discharge tray so that the discharge tray is opened when the discharge roller rotates in the first direction by an amount equal to or larger than a delayed rotation amount (delay accumulation amount) accumulated in the delay mechanism. The delay accumulation amount is accumulated in the delay mechanism according to the amount of rotation of the discharge roller in a second direction. When the same drive source is shared by the discharge roller and a suction pump for ink and the suction pump is actuated in conjunction with the rotation of the discharge roller in the first direction, the discharge roller is rotated in the second direction to sufficiently accumulate the delayed rotation amount (delay accumulating operation). Thus, the discharge tray can be prevented from being inadvertently opened while the suction pump is in operation.

For reduced size and cost of the printing apparatus, the same drive source is desirably used to drive not only the discharge roller and the suction pump but also a recovery mechanism that performs a recovery operation for a print head configured to print an image. The recovery operation is an operation for keeping the print head in an appropriate condition. For example, when the print head is an ink jet print head that can eject ink, the recovery operation includes an operation of wiping the print head, an operation of moving a cap for the print head, and an operation of setting the pressure in the cap to a negative value to suck ink from the print head.

When the same drive source is shared by such a recovery mechanism and the discharge roller, the delay accumulating operation needs to be frequently performed during the recovery operation. This results in the need of a long time for the recovery operation. Thus, when a job (print job) of printing an image is received during the recovery operation, the job is forced to wait for a long time until the recovery operation ends.

SUMMARY OF THE INVENTION

The present invention provides a printing apparatus that can quickly perform a needed job even if a recovery operation performed by a recovery mechanism needs a long time as a result of sharing of the same drive source between a discharge roller and a print head.

In the first aspect of the present invention, there is provided a printing apparatus comprising:

a print head configured to be able to apply ink onto a sheet to print an image;

a drive source;

a discharge roller configured to be rotationally driven by the drive source and to be able to discharge the sheet on which the image is printed by the print head;

a movable tray configured to move to a holding position where the movable tray is able to hold the sheet discharged by the discharge roller;

a transmission unit configured to transmit a rotation of the discharge roller in a first direction to the tray, wherein the transmission unit moving the tray to the holding position when the discharge roller rotates in the first direction by an amount equal to or larger than an delayed rotation amount accumulated in accordance with a rotation of the discharge roller in a second direction;

a recovery unit configured to be driven by the drive source and to be able to perform a recovery operation for recovering the print head; and a control unit configured to suspend the recovery operation when a particular job is received during the recovery operation, on a condition that the recovery unit is in a state where the recovery unit permits the particular job to be performed.

In the second aspect of the present invention, there is provided a method for controlling a printing apparatus comprising a print head configured to be able to apply ink onto a sheet to print an image, a drive source, a discharge roller configured to be rotationally driven by the drive source and to be able to discharge the sheet on which the image is printed by the print head, and a movable tray configured to move to a holding position where the movable tray is able to hold the sheet discharged by the discharge roller, the method comprising:

a moving step of transmitting a rotation of the discharge roller in a first direction to the tray, and moving the tray to the holding position when the discharge roller rotates in the first direction by an amount equal to or larger than an delayed rotation amount accumulated in accordance with a rotation of the discharge roller in a second direction;

a recovery step of performing a recovery operation for recovering the print head; and a step of suspending the recovery operation when a particular job is received during the recovery operation, on a condition that the printing apparatus is in a state where the printing apparatus permits the particular job to be performed.

According to the present invention, when a particular job such as a print job is received during a recovery operation for the print head, the particular job can be quickly performed by suspending the recovery operation on the condition that the particular job is permitted to be performed. This enables an increase in a user's wait time to be reduced, allowing usability to be enhanced.

Further features of the present invention will become apparent from the following description of exemplary embodiments (with reference to the attached drawings).

DESCRIPTION OF THE EMBODIMENTS

Embodiments of the present invention will be described below.

First Embodiment

Figure 1A:
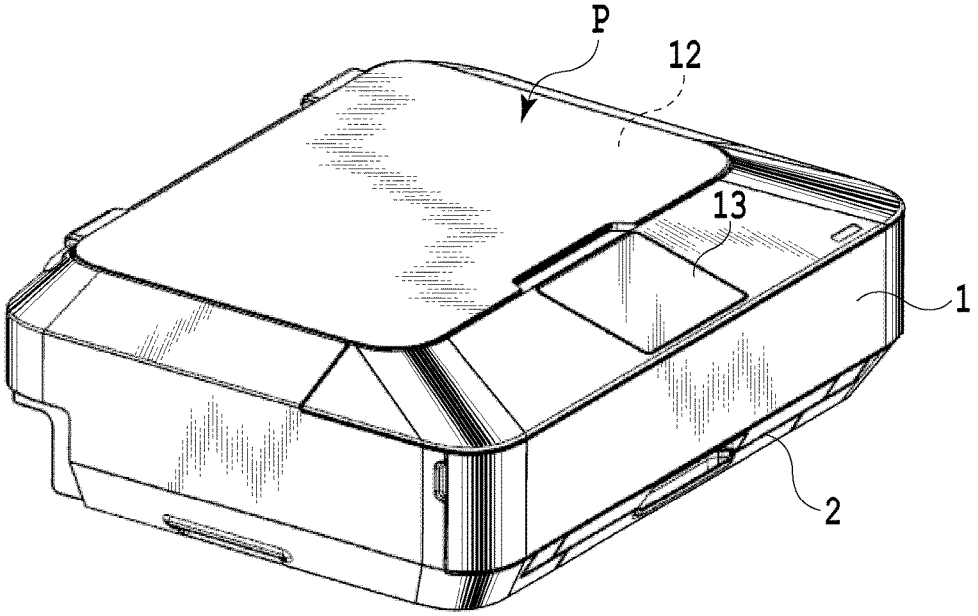
FIG. 1A and FIG. 1B are perspective views of a printing apparatus according to a first embodiment of the present invention.
Figure 1B:
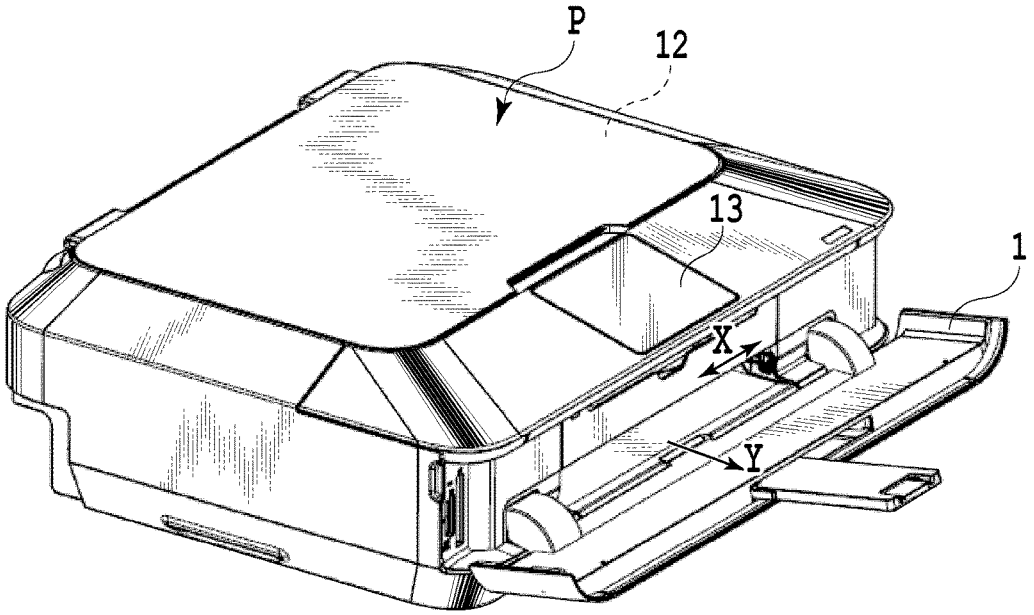

FIG. 1A and FIG. 1B are perspective views of a printing apparatus P according to a first embodiment. FIG. 1A shows that a discharge tray is closed, and FIG. 1B shows that the discharge tray is open.

The printing apparatus P includes a scanner 12 provided at the top of the printing apparatus P to read a document and an operation panel 13 also provided at the top of the printing apparatus P and via which various operations and settings are performed to give instructions to the printing apparatus. The printing apparatus P internally includes a sheet stacking section 2 in which sheets serving as print media are stacked, a sheet feeding section, a sheet conveying section, a printing section, and a discharge section. Sheets stacked in the sheet stacking section 2 are each fed to the sheet conveying section by the sheet feeding section. The sheet is then conveyed to the printing section by the sheet conveying section. In the printing section, an image is printed on the sheet, and the printed sheet is discharged by the discharge section.

The printing section in the present example prints an image by repeating reciprocation, along a main scan direction shown by arrow X, of a carriage on which a print head capable of ejecting ink and an ink tank are mounted and conveyance of the sheet in a sub-scan direction, crossing the main scan direction, shown by arrow Y (in the present example, the sub-scan direction is orthogonal to the main scan direction). The print head can eject ink through an ink ejection port using an ink ejection energy generating element such as an electrothermal conversion element or a piezo element. The discharge section includes a discharge roller that can discharge sheets and a discharge tray that holds sheets, as described below. Furthermore, the printing apparatus P includes a recovery section that can perform a recovery operation of allowing the print head to keep appropriate ejection of ink.

Figure 2:
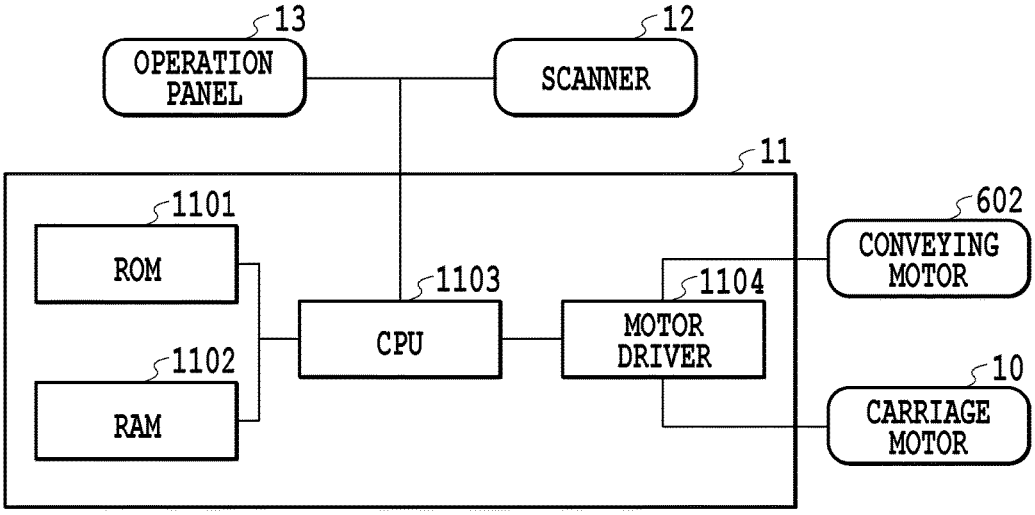
FIG. 2 is a block diagram of a control system in the printing apparatus in FIG. 1.

FIG. 2 is a block diagram of a control system in the printing apparatus P.

The carriage is reciprocated by a carriage motor 10. The conveying section and the discharge roller of the discharge section are driven by a conveying motor 602. A control board 11 in the printing apparatus P includes ROM 1101, RAM 1102, a CPU 1103, and a motor driver 1104. The CPU 1103 executes control processing for the operation of the printing apparatus, data processing, and the like. The ROM 1101 stores programs for process procedures for the control processing, the data processing, drive profiles and parameters for the motors, and the like. The RAM 1102 is used as a work area in which the processing is executed, and stores temporary constants and the like. The CPU 1103 controls the carriage motor 10 and the conveying motor 602 (drive source) via the motor driver 1104.

Figure 3:
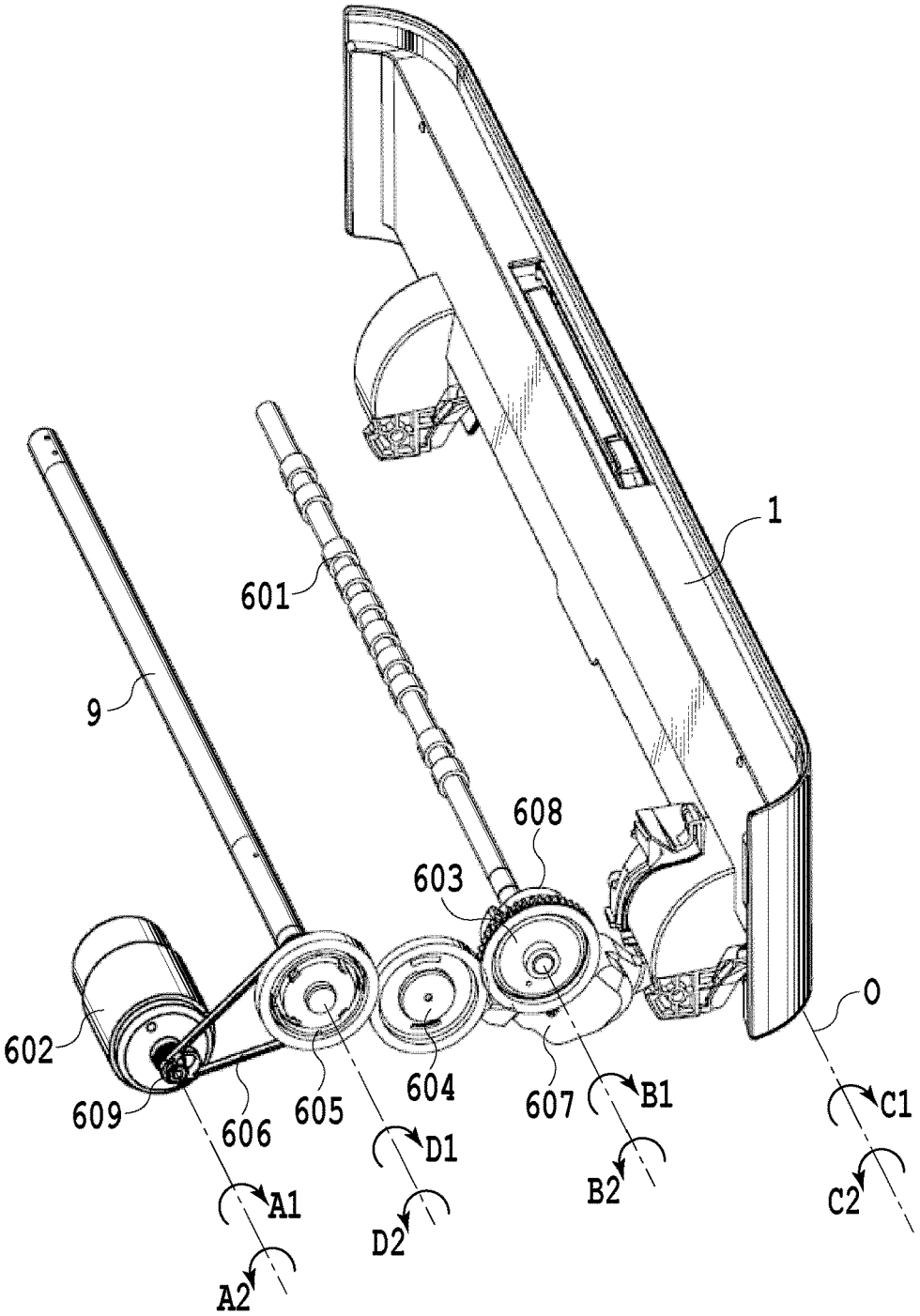
FIG. 3 is a perspective view of a driving section of the printing apparatus in FIG. 1.

FIG. 3 is a perspective view showing a driving system for the discharge section.

A conveying roller 9 of the conveying section is rotationally driven by the conveying motor 602 via pulleys 605 and 609 and a belt 606. Moreover, the rotating force of the conveying roller 9 is transmitted to a discharge roller 601 of the discharge section via gears 603 and 604. The gear 603 is a discharge roller gear. When the conveying motor 602 rotates forward in a direction shown by arrow A1, the discharge roller 601 rotates in a direction (first direction) shown by arrow B1 and in which the sheet is discharged into the discharge tray 1. Furthermore, when the conveying motor 602 rotates backward in a direction shown by arrow B2, the discharge roller 601 rotates in a direction (second direction) shown by arrow B2 and in which the sheet is retracted into an apparatus main body.

The discharge tray 1 is attached to a lower portion of a front surface of the main body of the printing apparatus P so as to be able to move rotationally around an axis O. The discharge tray 1 is opened when rotationally moved in a direction shown by arrow C1, and is closed when rotationally moved in a direction shown by arrow C2. A rotating lever 607 that is a combination of link members is provided near the axis O. The discharge tray 1 moves rotationally in conjunction with the rotating lever 607. A discharge roller cam 608 is attached to a rotating shaft of the discharge roller 601. The rotating force of the discharge roller 601 is transmitted to the discharge roller cam 608 via a delay mechanism (transmission mechanism) described below.

FIG. 6A, FIG. 6B, FIG. 6C, and FIG. 6D are each a diagram illustrating the relation between the rotating lever 607 and the discharge roller cam 608.

Figure 6A:
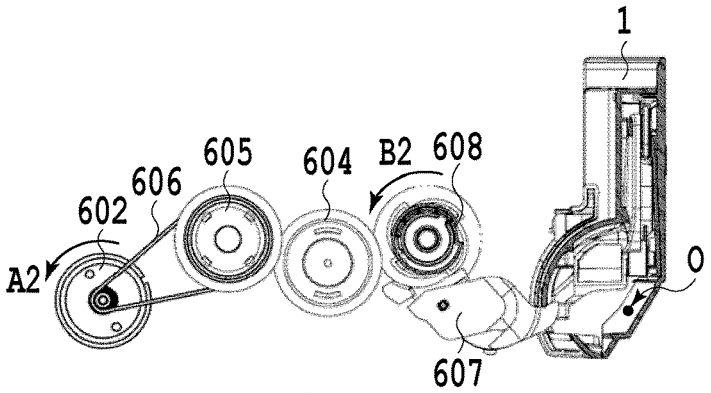
FIG. 6A, FIG. 6B, FIG. 6C, and FIG. 6D are diagrams illustrating operation of the driving section in FIG. 3.
Figure 6B:
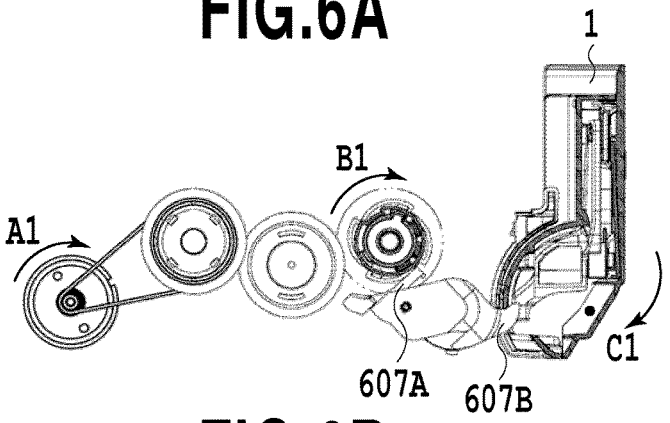
Figure 6C:
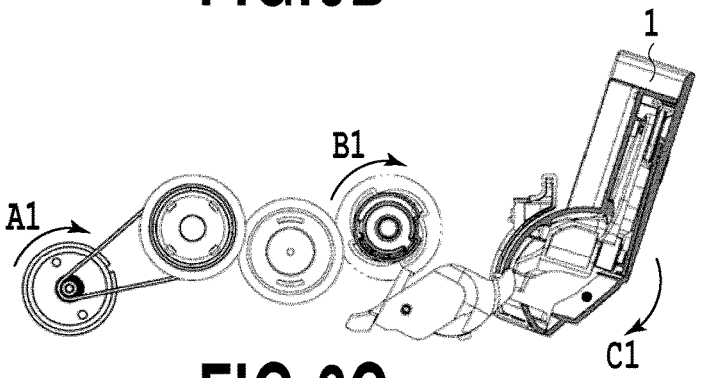
Figure 6D:
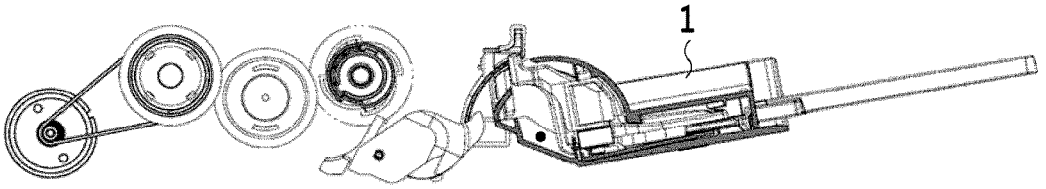

While the discharge tray 1 is closed, the rotating lever 607 is in contact with the discharge roller cam 608 as shown in FIG. 6A. When the discharge roller cam 608 rotates forward in the direction shown by arrow B1, a first end 607A of the rotating lever 607 is pushed downward to move a second end 607B upward, which is in contact with the discharge tray 1. As a result, the discharge tray 1 is opened as shown in FIG. 6B, FIG. 6C, and FIG. 6D. The discharge tray 1 is opened to a position where sheets are held in the discharge tray 1 as shown in FIG. 6D, and a part of the discharge tray 1 is withdrawn. On the other hand, in a case where the discharge tray 1 is closed as shown in FIG. 6A, if the discharge roller cam 608 is rotated backward in the direction shown by arrow B2, no force pushing the rotating lever 607 acts due to the cam shape of the discharge roller cam 608. Thus, the discharge tray 1 remains closed as shown in FIG. 6A and is not opened. Furthermore, with the discharge tray 1 open as shown in FIG. 6D, the rotating lever 607 is not in contact with the discharge roller cam 608, and thus, the discharge roller cam 608 and the rotating lever 607 are prevented from moving in conjunction with each other.

Figure 4:
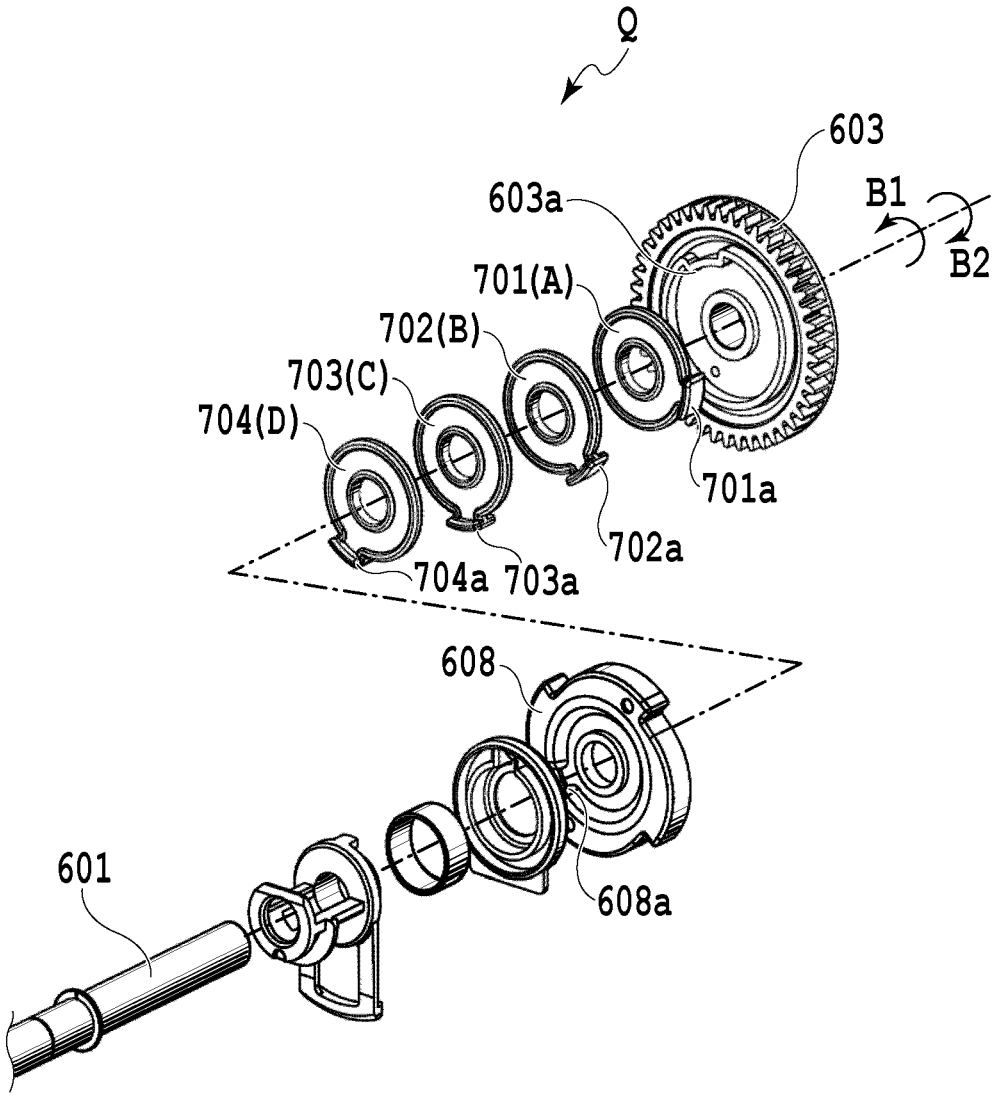
FIG. 4 is an exploded perspective view of a delay mechanism provided in the driving section in FIG. 3.
Figure 5:
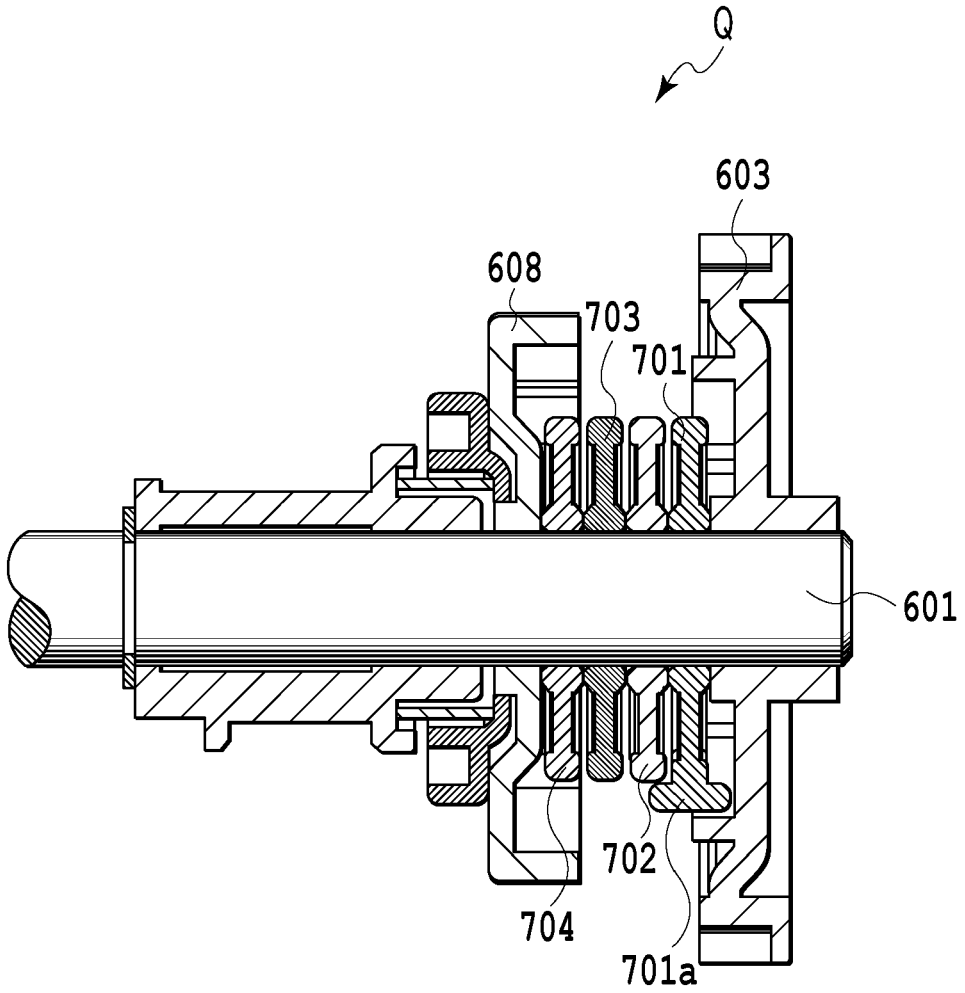
FIG. 5 is a cross-sectional view of the delay mechanism in FIG. 4.

FIG. 4 and FIG. 5 are diagrams of the delay mechanism (transmission mechanism) that transmits the rotating force of the discharge roller 601 to the discharge roller cam 608.

The delay mechanism in the present example includes four ring-like members 701, 702, 703, and 704 rotatably provided on the same shaft of the discharge roller 601 and the discharge roller gear 603 as shown in FIG. 4. The ring-like members 701, 702, 703, and 704 are provided with respective projecting portions 701*a*, 702*a*, 703*a*, and 704*a*. The ring-like members 701, 702, 703, and 704 are arranged such that the distance from the discharge roller 601 to the ring-like member decreases in the following order: 701, 702, 703, and 704. The ring-like members are hereinafter also denoted by A, B, C, and D. The discharge roller gear 603 transmits a drive force from the conveying motor 602 to the discharge roller 601. To achieve this, the discharge roller gear 603 is fixed to the discharge roller 601. Thus, the discharge roller gear 603 rotates completely synchronously with the discharge roller 601. On the other hand, the four ring-like members A, B, C, and D and the discharge roller cam 608 are rotatably attached on the same axis of the discharge roller 601. A projecting portion 603*a* of the discharge roller gear 603, the projecting portions 701*a*, 702*a*, 703*a*, and 704*a* of the ring-like members A, B, C, and D, and a projecting portion 608*a* of the discharge roller cam 608 are arranged adjacently to one another in this order. The adjacent projecting portions come into abutting contact with one another to form a power transmission system that transmits power between the discharge roller gear 603 and the discharge roller cam 608.

Now, operation of the delay mechanism configured as described above will be described.

When the conveying motor 602 rotates forward in the direction shown by arrow A1, the discharge roller 601 and the discharge roller gear 603 rotate forward in the direction shown by arrow B1 synchronously with the rotation of the conveying motor 602. Then, by the time when the discharge roller gear 603 makes one rotation in the direction shown by arrow B1, the projecting portion 603*a* of the discharge roller gear 603 and the projecting portion 701*a* of the ring-like member A come into abutting contact with each other. Subsequently, the ring-like member A rotates forward synchronously with the discharge roller gear 603. By the time when the ring-like member A makes one rotation, the projecting portion 701*a* of the ring-like member A and the projecting portion 702*a* of the ring-like member B come into abutting contact with each other. Subsequently, the ring-like member B rotates forward synchronously with the ring-like member A. By the time when the ring-like member B makes one rotation, the projecting portion 702*b* of the ring-like member B and the projecting portion 703*a* of the ring-like member C come into abutting contact with each other. Subsequently, the ring-like member C rotates forward synchronously with the ring-like member B. By the time when the ring-like member C makes one rotation, the projecting portion 703*b* of the ring-like member C and the projecting portion 704*a* of the ring-like member D come into abutting contact with each other. Subsequently, the ring-like member D rotates forward synchronously with the ring-like member B. By the time when the ring-like member D makes one rotation, the projecting portion 704*b* of the ring-like member D and the projecting portion 608*a* of the discharge roller cam 608 come into abutting contact with each other. Subsequently, the discharge roller cam 608 rotates forward synchronously with the discharge roller 601, the discharge roller gear 603, and the ring-like members A, B, C, and D.

As described above, in the transmission of power from the discharge roller 601 to the discharge roller cam 608, until the adjacent projecting portions all come into abutting contact with one another, the discharge roller 601 rotates forward, whereas the discharge roller cam 608 remains immobile. After the adjacent projecting portions all come into abutting contact with one another, the discharge roller cam 608 rotates forward along with the discharge roller 601. Thus, the start of rotation of the discharge roller cam 608 is delayed until the adjacent projecting portions all come into abutting contact with one another.

On the other hand, when the conveying motor 602 rotates backward in the direction shown by arrow A2, the discharge roller 601 and the discharge roller gear 603 rotate backward in the direction shown by arrow B2 synchronously with the conveying motor 602. As is the case with the forward rotation of the conveying motor 602, the adjacent projecting portions of the discharge roller gear 603, the ring-like members A, B, C, and D, and the discharge roller cam 608 come sequentially into abutting contact with one another. After the adjacent projecting portions all come into abutting contact with one another, the discharge roller cam 608 starts rotating backward.

As described above, the conveying motor 602 needs to be rotated forward over the longest period (delay period) after the discharge roller cam 608 is rotated backward along with the discharge roller 601 and before the discharge roller cam 608 is rotated forward along with the discharge roller 601. Thus, when the conveying motor 602 is rotated backward to rotate the discharge roller cam 608 backward along with the discharge roller 601, a delay period is maximized which lasts from the start of forward rotation of the conveying motor 602 until the discharge tray 1 performs an opening operation. In other words, the maximum delayed rotation amount is accumulated in the delay mechanism as the maximum delay amount. In the present example, the maximum delayed rotation amount corresponds to a rotation of the conveying roller 9 through an angle of approximately 247 degrees. Furthermore, any delayed rotation amount that is equal to or smaller than the maximum delayed rotation amount can be accumulated as a delay amount according to the amount of backward rotation of the conveying motor 602. When the discharge roller 601 rotates forward by an amount equal to or larger than the delayed rotation amount accumulated in the delay mechanism, the discharge tray 1 performs an opening operation.

Figure 7:
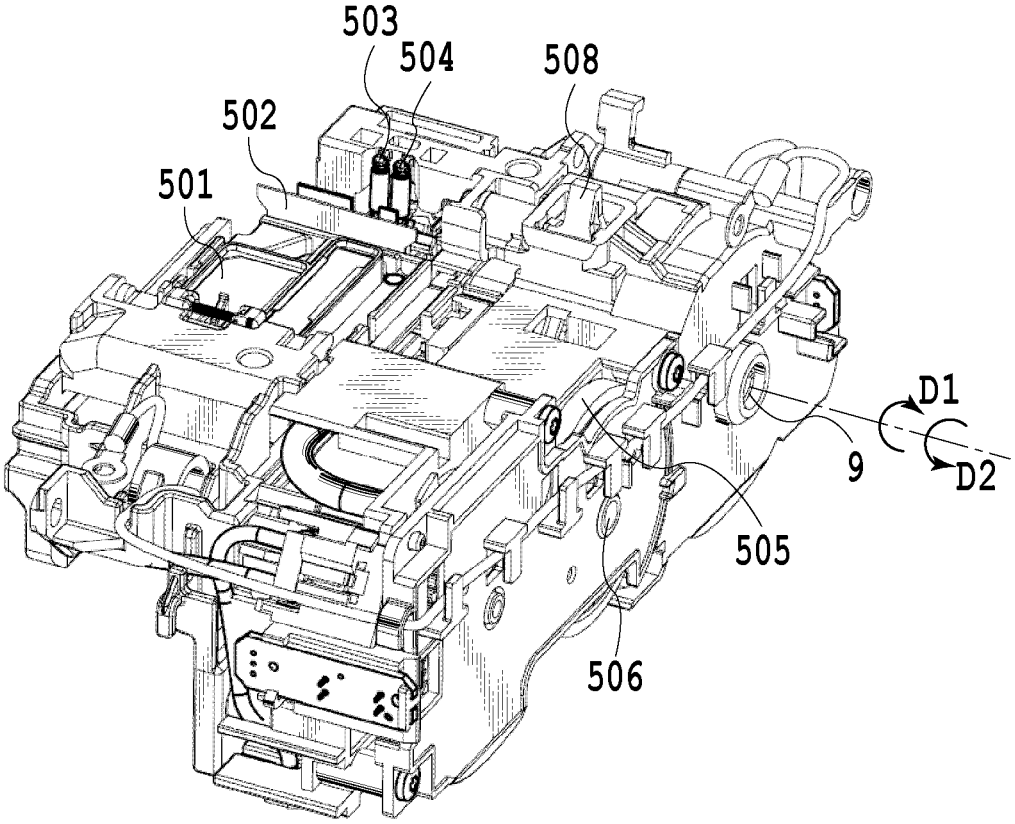
FIG. 7 is a perspective view of a recovery mechanism provided in the printing apparatus in FIG. 1.

FIG. 7 is a perspective view illustrating a configuration of the recovery section.

The printing apparatus P in the present example is an ink jet printing apparatus. The print head 520 includes very small ejection ports through which ink is ejected Ink mist may be attached to an ejection surface of the print head 520 in which the ejection ports are formed. Bubbles may be generated in ink channels in the print head 520. To keep appropriate ejection of ink from the print head 520, ink needs to be restrained from clogging in the ejection ports and to be filled from each of the ink channels to the corresponding ejection port. Furthermore, when the print head 520 is configured to eject inks in a plurality of colors, the ejection port surface needs to be wiped clean in order to prevent the inks from being mixed. These operations correspond to a recovery operation for keeping appropriate ejection of ink from the print head 520. The recovery operation includes an operation for keeping appropriate ejection of ink from the print head 520 and accompanying operational sequences in general. For example, the recovery operation includes wiping of the ejection port surface, a cap close operation of bringing a cap into tight contact with the ejection port surface, a cap open operation of removing the cap, an ink sucking operation of sucking ink into the cap through the ejection ports, and a cleaning operation for the print head 520 which is a mixture of the above-described operations.

The recovery section includes a cap 501 that comes into tight contact with the ejection port surface of the print head 520, a wiper 502 that wipes the ejection port surface of the print head 520, a carriage lock pin 508 that regulates positional relations with the carriage, and a pump 505. The cap 501 for the print head 520 connects to the pump 505 via a valve 503 for color ink and a valve 504 for black ink. A tube pump is adopted as the pump 505. A pump roller section 506 with a roller (pump roller) that is pressed against a pump tube is rotated to suck ink in the cap 501 (idle suction).

The drive force of the recovery section is transmitted from the conveying roller 9 via a revolver mechanism also provided in the recovery section. The revolver mechanism can press the carriage against a clutch to switch the clutch on and off. While the clutch is on, a transmission system is disconnected which transmits a drive force from the conveying roller 9 to the recovery section. While the clutch is off, the transmission system is connected which transmits a drive force from the conveying roller 9 to the recovery section.

While the clutch is off, when the conveying roller 9 rotates backward in a direction shown by arrow D2, the pump roller section 506 rotates forward in conjunction with the backward rotation of the conveying roller 9 to suck ink through the cap 501. Furthermore, when the conveying roller 9 rotates forward in a direction shown by arrow D1, the pump roller section 506 rotates backward in conjunction with the forward rotation of the conveying roller 9, while a recovery cam 507 (see FIG. 8A) simultaneously rotates forward. The backward rotation of the pump roller section 506 cancels the pressure contact of the roller with the pump tube. One forward rotation of the conveying roller 9 completely cancels the pressure contact of the roller to initialize the pump.

The recovery cam 507 is provided on the same shaft on which the conveying roller 9 is installed. While recovery cam 507 is making one rotation, the following operations are sequentially performed: opening and closing of the valves 503 and 504, lowering of the carriage lock pin 508, lowering of the cap 501, reciprocation of the wiper 502, raising of the carriage lock pin 508, and raising of the cap 501. While the conveying roller 9 is rotating backward in the direction shown by arrow D2, the recovery cam 507 is prevented from rotating.

As described above, the recovery section is driven by the forward rotation of the conveying motor 602. The conveying roller 9 and the discharge roller 601 also rotate in conjunction with each other while the recovery section is being driven.

FIG. 8A, FIG. 8B, FIG. 9A, and FIG. 9B are perspective views of the recovery mechanism illustrating the relations between the position of the recovery cam 507 and the wiper 502, the carriage lock pin 508, and the cap 501.

Figure 8A:
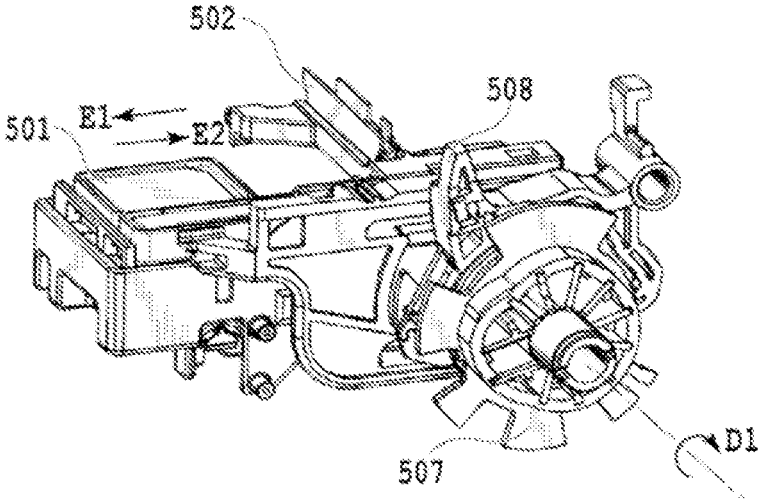
FIG. 8A and FIG. 8B are perspective views illustrating operation of the recovery mechanism in FIG. 7.
Figure 8B:
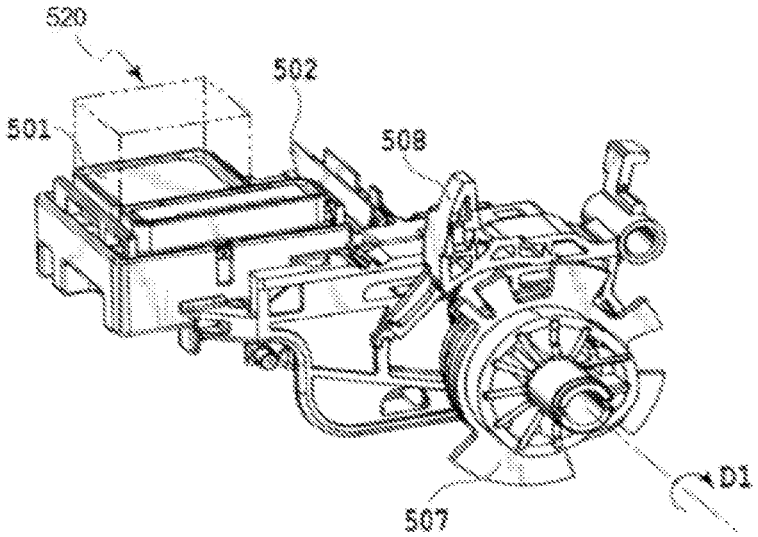
Figure 9A:
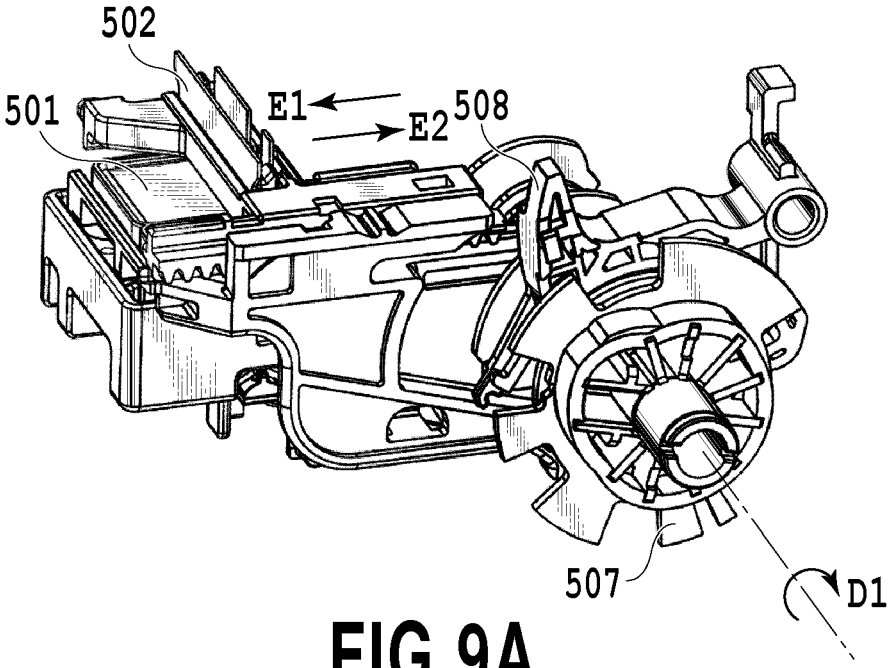
FIG. 9A and FIG. 9B are perspective views illustrating operation of the recovery mechanism in FIG. 7.
Figure 9B:
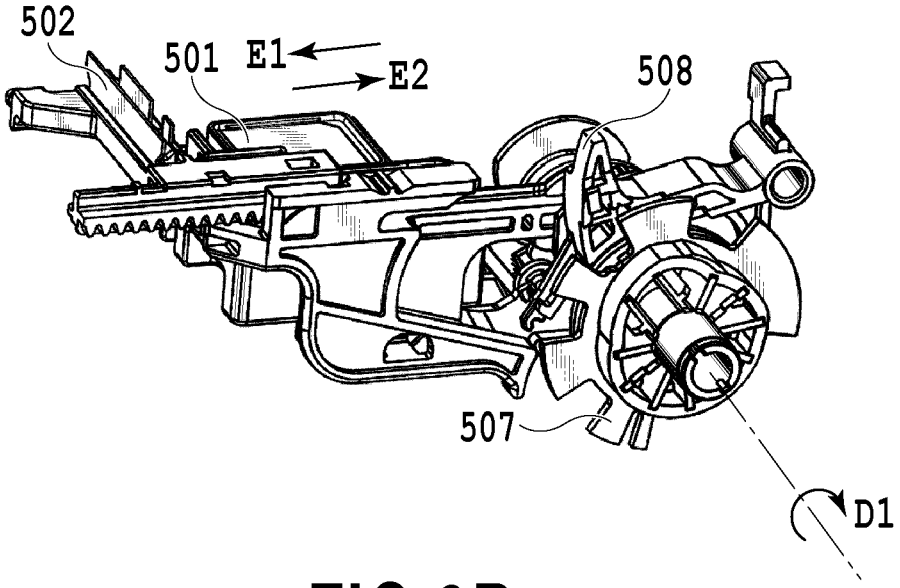

In conditions shown in FIG. 8A, FIG. 9A, and FIG. 9B, the cap 501 is in its lowered position. In a condition shown in FIG. 8B, the cap 501 is in its raised position. The carriage is moved to a position over the cap 501, and the recovery cam 507 is then rotated to raise and bring the cap 501 into tight contact with the ejection port surface of the print head 520. The ejection ports are thus protected from drying. When the cap 501 is in the raised position, the cap 501 and the carriage, which reciprocates for a printing operation, interfere with each other. Thus, during the printing operation, the cap 501 needs to be in the lowered position. In other words, in order to perform a print job, the cap 501 needs to lie in the lowered position to permit the performance (printing operation).

In conditions shown in FIG. 8A, FIG. 9A, and FIG. 9B, the carriage lock pin 508 is in its lowered position. In a condition shown in FIG. 8B, the carriage lock pin 508 is in its raised position. The carriage is moved to a position over the cap 501, and the recovery cam 507 is then rotated to slide the carriage lock pin 508 into a recess portion of the carriage to fix the carriage so as to keep the carriage immobilized. When the carriage lock pin 508 is in the raised position, the carriage lock pin 508 and the carriage, which reciprocates for the printing operation, interfere with each other. Thus, during the printing operation, the carriage lock pin 508 needs to be in the lowered position.

In conditions shown in FIG. 8A and FIG. 8B, the wiper 502 is in its home position. In a condition shown in FIG. 9B, the wiper 502 is in its away position. In a condition shown in FIG. 9A, the wiper 502 is in its moving position. The recovery cam 507 rotates to move the wiper 502 from the home position toward the away position in a direction shown by arrow E1, thus wiping the ejection port surface of the print head 520. When the wiper 502 is in the moving position as shown in FIG. 9A, the wiper 502 and the carriage, which reciprocates for the printing operation, interfere with each other. Thus, during the printing operation, the wiper 502 needs to return to the home position so as to prevent dirt on the wiper 502 from being attached to the print head 520.

During the printing operation, the cap 501 and the carriage lock pin 508 each need to be in the lowered position, while the wiper 502 needs to be in the home position, as shown in FIG. 8A. The rotating position of the recovery cam 507 in the condition shown in FIG. 8A is hereinafter referred to as a standby position. A drive sequence for the recovery section is ended while the recovery cam 507 is in the standby position, to allow driving sections for the printing operation and the like except the recovery section to be quickly driven after the sequence ends.

As described above, the conveying roller 9 and the discharge roller 601 can also be rotated without the need to drive the recovery section by using the revolver mechanism to disconnect the transmission system that transmits the drive force to the recovery section. When the conveying motor 602 is rotated backward after the transmission of the drive force to the recovery section is disabled, a delay amount for preventing the discharge tray 1 from being opened can be accumulated without the need to drive the recovery section as described below.

When a drive sequence and an operational sequence for each section of the printing apparatus are executed, a program and parameter data stored in ROM 1101 are loaded by the CPU 1103 and expanded onto RAM 1102. The CPU 1103 then controls each section based on the program and parameter data. When the recovery section is driven, the discharge roller 601 rotates forward in the direction shown by arrow B1 in conjunction with the driving of the recovery section. Thus, the discharge tray 1 may be opened in conjunction with the discharge roller 601. It is not preferable in terms of usability that the discharge tray 1 be inadvertently opened while the printing apparatus is performing an operation not involving discharge of sheets.

In the present example, when the conveying roller 9 is rotated forward through the angle of 247 degrees or more in total during a series of operational sequences for the recovery section, a sequence in which the delay amount for preventing the discharge tray 1 from being opened is accumulated (hereinafter referred to as a "delay accumulation sequence") is executed between operations of the recovery section. For example, the delay accumulation sequence is executed during the cap close sequence.

The cap close sequence is a sequence in which a series of operations including wiping, suction (idle suction), and a cap close operation are performed. The wiping is an operation of wiping the ejection port surface of the print head 520 clean. The suction (idle suction) is an operation of sucking waste ink collected in the cap 501 using the pump 505. Furthermore, the cap close operation is an operation of raising and bringing the cap 501 into tight contact with the ejection port surface of the print head 520.

During the sequences, the wiping is performed by rotating the recovery cam 507 through an angle of 360 degrees in total. Furthermore, after waste ink is sucked using the pump 505, the pump roller section 506 is rotated backward to cancel the pressure contact of the roller with the pump tube. To achieve this, the conveying roller 9 needs to be rotated forward through an angle of 360 degrees. Hence, to prevent the discharge tray 1 from being inadvertently opened, the delay accumulation sequence is executed before the conveying roller 9 is rotated forward trough an angle of 360 degrees, in other words, the delay accumulation sequence is executed between a wiping operation and backward rotation of the pump roller section 506.

However, execution of the delay accumulation sequence increases a time needed for the entire cap close sequence. Thus, during the cap close sequence, when the recovery cam 507 is in the standby position, whether or not a print job has been received is determined, and the cap close sequence is suspended if a print job has been received.

Figure 10:
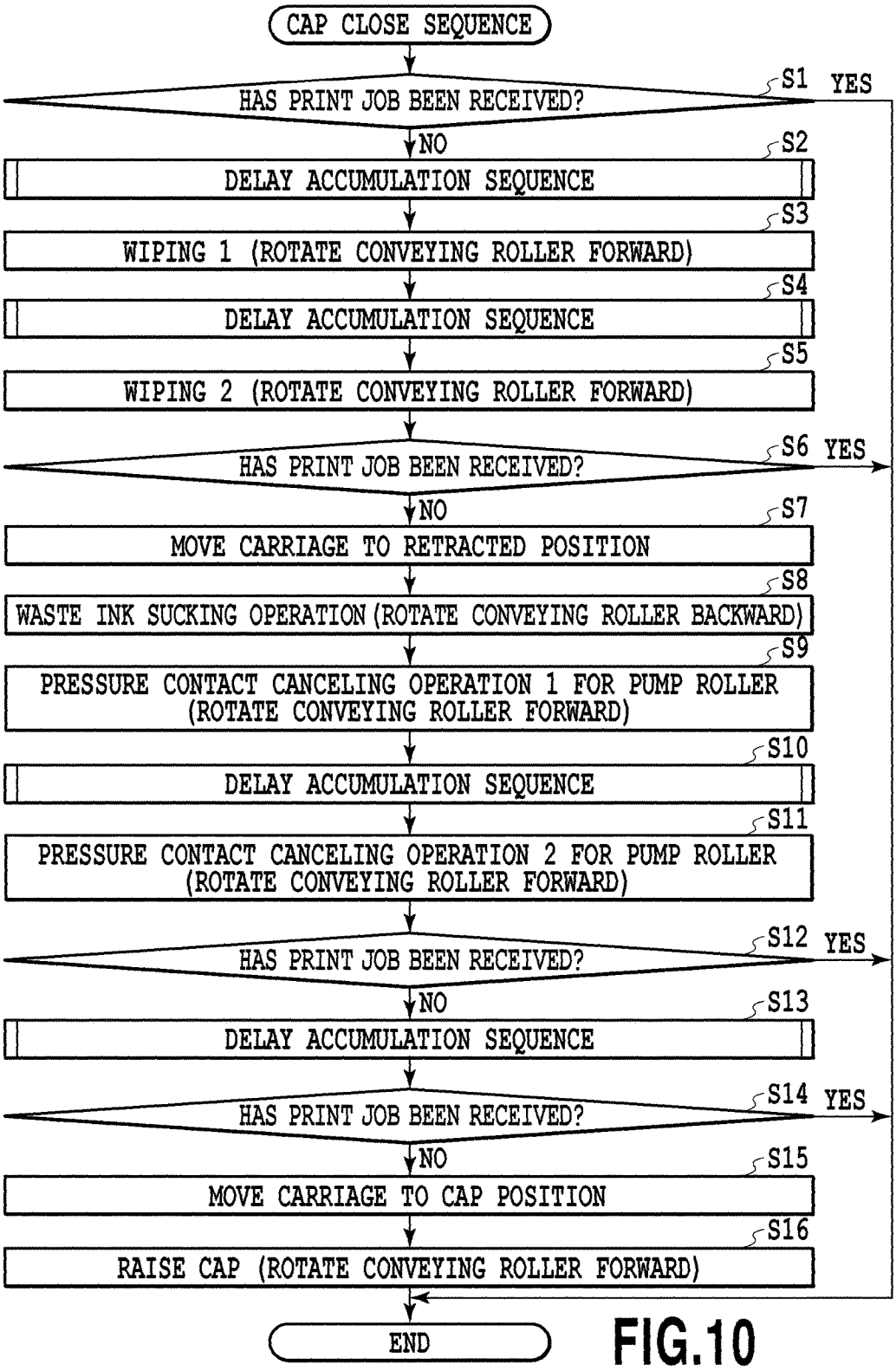
FIG. 10 is a flowchart illustrating a cap close sequence according to the first embodiment of the present invention.

FIG. 10 is a flowchart illustrating the cap close sequence, executed by the CPU 1103.

During the cap close sequence, before delay accumulation, the CPU 1103 determines whether or not a print job has been received (step S1). If a print job has been received, the CPU 1103 ends the cap close sequence. At this time, in the recovery section, the cap 501 and the carriage lock pin 508 are each in the lowered position, and the wiper 502 is in the home position. In other words, the recovery cam 507 is in the standby position. Like in step S1, in step S6, step S12, and step S14, where the recovery cam 507 is in the standby position, the CPU 1103 determines whether or not a print job has been received, and if a print job has been received, ends the cap close sequence.

If no print job has been received, the CPU 1103 performs delay accumulation for preventing the discharge tray 1 from being opened (delay accumulation sequence). The delay accumulation sequence will be described below. Then, the CPU 1103 carries out wiping 1 (step S3) to perform an operation of wiping the ejection port surface of the print head using the wiper 502 (movement in a direction shown by arrow E1) and an operation of returning the wiper 502 (movement in a direction shown by arrow E2). The wiping 1 is performed by rotating the conveying roller 9 forward through an angle of approximately 150 degrees to rotate the recovery cam 507 forward. Wiping 2 performed in later step S5 is an operation of rotating the recovery cam 507 to the standby position and is carried out by rotating the conveying roller 9 forward through an angle of approximately 210 degrees. The total amount of forward rotation of the conveying roller 9 in the wiping 1 and the wiping 2 (step S3 and step S5) exceeds the maximum amount (the rotation angle of 247 degrees) of forward rotation that can be accumulated in the delay mechanism. Thus, the delay accumulation sequence is executed between the wiping 1 and the wiping 2 (step S4). When the delay accumulation sequence is started in step S4, the recovery cam 507 is not in the standby position. Consequently, the CPU 1103 omits the operation of determining whether or not a print job has been received so that the cap close sequence can be suspended depending on the determination.

After performing the wiping 2, the CPU 1103 determines again whether or not a print job has been received (step 6), and if a print job has been received, ends the cap close sequence. If no print job has been received, the carriage is moved to its retracted position (step S7). The retracted position is set such that, when the carriage is in the retracted position, the print head is away from the position over the cap 501.

In the next step S8, the CPU 1103 performs a waste ink sucking operation to discharge waste ink collected in the cap 501 using the pump 505. This operation sufficiently rotates the conveying roller 9 backward, while simultaneously accumulating the delay for preventing the discharge tray 1 from being opened, up to the maximum amount. Pressure contact cancelling operations 1 and 2 for the pump roller which are subsequently performed in subsequent steps S9 and S11 rotate the pump roller section 506 backward in order to cancel the pressure contact of the pump roller with the pump tube. First, in step S9, the pressure contact canceling operation 1 is performed by rotating the conveying roller 9 forward though an angle of approximately 150 degrees. Then, in step S10, the delay accumulation sequence is executed. Subsequently, in step S11, the pressure contact canceling operation 2 is performed by rotating the conveying roller 9 forward through the remaining angle of approximately 210 degrees. The pressure contact canceling operation 2 causes most of the delay amount accumulated in the previous step S8 to be consumed.

In the next step S12, the CPU 1103 determines whether or not a print job has been received, and if a print job has been received, ends the cap close sequence. If no print job has been received, the CPU 1103 executes the delay accumulation sequence again to provide for the next forward rotation of the conveying roller 9 (step S13). Subsequently, the CPU 1103 determines again whether or not a print job has been received, and if a print job has been received, ends the cap close sequence. If no print job has been received, the CPU 1103 moves the carriage to a position over the cap 501 (step S15). Thereafter, the CPU 1103 rotates the conveying roller 9 forward to rotate the recovery cam 507, thus raising the cap 51 until the cap comes into tight contact with the ejection port surface of the print head (step S16).

Figure 11:
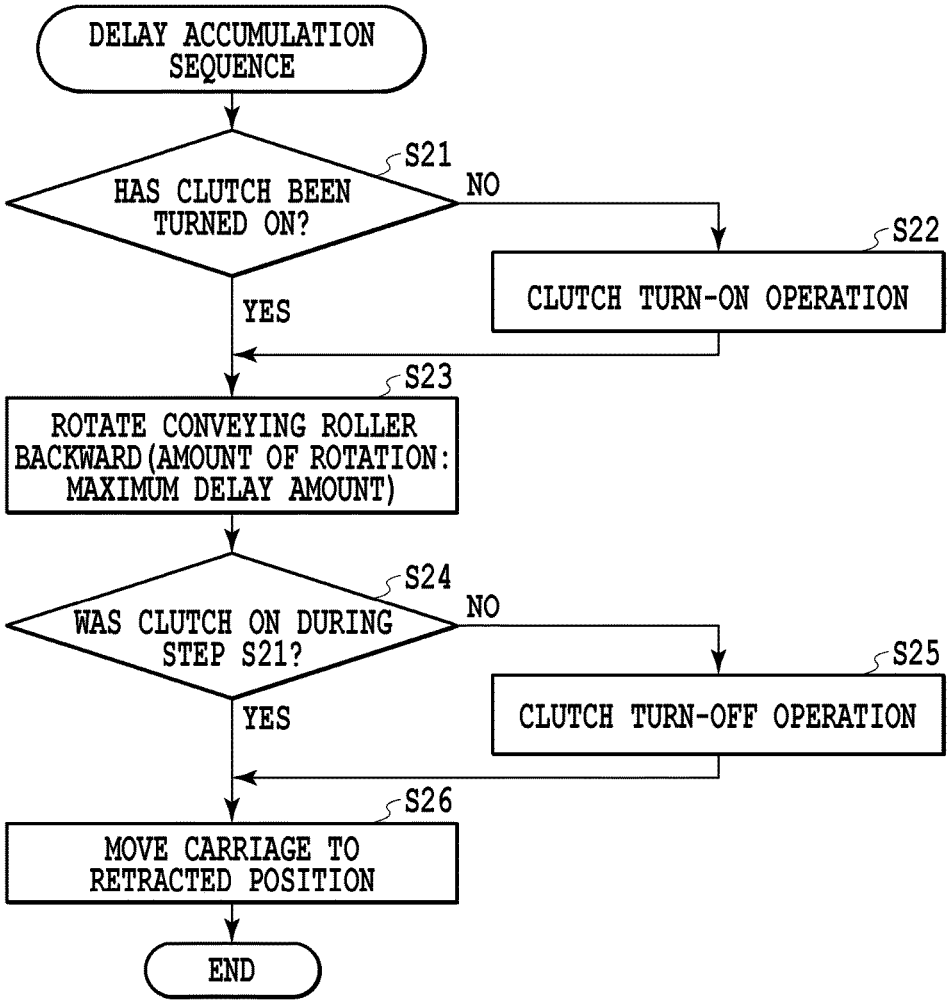
FIG. 11 is a flowchart illustrating a delay accumulation sequence.

FIG. 11 is a flowchart illustrating the delay accumulation sequence.

First, the CPU 1103 determines the condition of the clutch between the conveying roller 9 and the recovery section (step S21). The result of the determination is stored in RAM 1102. When the clutch is not on, the CPU 1103 turns the clutch on (step S22) to disconnect the transmission system that transmits a drive force from the conveying roller 9 to the recovery section. With the driving system for the recovery section disconnected, the CPU 1103 allows the conveying motor 602 to rotate the conveying roller 9 backward to accumulate the delay for preventing the discharge tray 1 from being opened (step S23). At this time, the conveying roller 9 rotates through an angle of approximately 247 degrees to allow the maximum delay amount to be reliably accumulated. After performing such delay accumulation, the CPU 1103 references data stored in RAM 1102 to determine whether or not the clutch was on during the previous step S21 (step S24). If the clutch is determined to have been off during step S21, the CPU 1103 turns the clutch back off (step S25). Finally, the CPU 1103 moves the carriage to the retracted position to end the delay accumulation sequence.

The cap close operation is intended mainly to prevent the ejection port surface of the print head from being dried and is one of the basic recovery operations in the ink jet printing apparatus. The cap close sequence is normally available as a software component and is executed in various situations while the printing apparatus is in operation. As described below, the cap close sequence is executed, for example, when no printing operation is performed for a given time with the cap remaining open, during an operation involved in a process of powering the printing apparatus main body off, and during a cleaning operation for the print head.

When no printing operation is performed for a given time with the cap remaining open, the CPU 1103 executes a process for a given-period left-uncontrolled case. The process for a given-period left-uncontrolled case is an operation of closing the print head with the cap to establish a standby state in order to prevent the ejection port surface of the print head from being dried when the CPU 1103 determines that the user will not perform printing for a while. The process of powering the printing apparatus main body off is executed when the CPU 1103 assumes that the user finishes utilizing the printing apparatus and is intended to prevent the ejection surface of the print head from being dried until the next time the printing apparatus is actuated. Specifically, the CPU 1103 closes the print head with the cap, stores needed information in ROM 1101, and finally turns off the power supplied to the printing apparatus.

When no printing operation is performed for a given time with the cap remaining open and during the cap close operation involved in the process of powering off the printing apparatus main body, the discharge tray 1 may have been closed by the user before the cap close operation. In such a case, inadvertent opening of the discharge tray 1 during the cap close operation is not preferable for the user. Such inadvertent opening of the discharge tray 1 can be prevented by executing the delay accumulation sequence in step S2, step S4, step S10, and step S13 in FIG. 10.

In the present example, the total time needed for the following is approximately 6 seconds: an operation of turning the clutch on during the delay accumulation sequence (step S22), an operation of rotating the conveying roller backward (step S23), an operation of turning the clutch off (step S25), and movement of the carriage (step S26). Such a delay accumulation sequence is executed four times during the cap close sequence in FIG. 10, and thus, a temporal difference of approximately 24 seconds is present between a case where the delay accumulation sequences are executed and a case where no delay accumulation sequences are executed. Thus, if the user requests the printing apparatus to perform a printing operation immediately after the start of the cap close operation, then due to the direct adverse effect of the temporal difference of approximately 24 seconds, approximately 24 seconds more time needs to elapse before the printing operation starts.

Thus, according to the first embodiment, when the recovery cam 507 is in the standby position during the cap close sequence in FIG. 10, the CPU 1103 determines whether or not a print job has been received, and if a print job has been received, suspends the cap close operation, as described above. Then, the CPU 1103 performs a printing operation in accordance with the print job. The time needed for the cap close sequence increases as a result of execution of the delay accumulation sequence in FIG. 11. However, after the printing apparatus receives the user's request for printing, while the recovery cam 507 is in the standby position, the CPU 1103 can determine whether or not a print job has been received, and if a print job has been received, suspend the cap close process. This enables an increase in the user's wait time resulting from the delay accumulation sequence to be reduced.

The cap close sequence in the present example is a combination of wiping, idle suction and raising of the cap. The conveying roller is rotated forward while any of these processes is in execution, and in contrast, the conveying roller is rotated backward in order to accumulate the delay for preventing the discharge tray 1 from being opened. When each of the processes in the cap close sequence starts or ends, the recovery cam is in the standby position, the CPU 1103 determines, before and after the process, whether or not a print job has been received. This is effective even when the printing apparatus includes a recovery section different from the recovery section in the present example and when the processes of the cap close sequence are in a sequence or an order different from the sequence or order of the processes in the present example. That is, even in such a case, when the recovery section is in a condition that enables a printing operation to be quickly started, the CPU 1103 can determine whether or not a print job has been received, and if a print job has been received, suspend the cap close process. The condition for the suspension of the cap close sequence may be, instead of the reception of a print job as in the present case, the condition of the print head, ink, or the like, reception of a replacement job for a replaceable consumable component in the printing apparatus, or reception of a cleaning job for the print head or the conveying roller.

Second Embodiment

Like in the first embodiment, in the second embodiment, the CPU 1103 executes the delay accumulation sequence in FIG. 11. However, the CPU 1103 periodically determines whether or not a print job has been received even while the conveying roller 9 is rotating backward during the delay accumulation sequence (while a delayed rotation amount is being accumulated), and if a print job has been received, suspends the backward rotation of the conveying roller 9.

Figure 12:
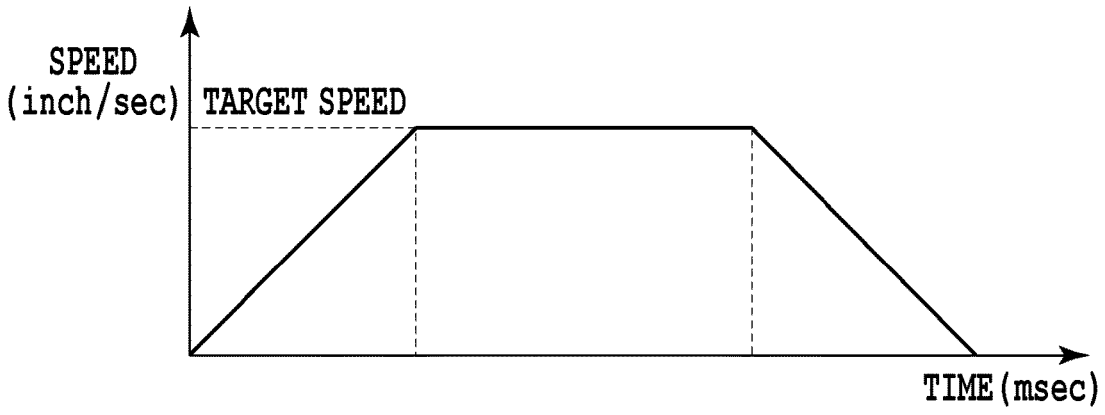
FIG. 12 is a diagram illustrating the form of control of a conveying motor according to a second embodiment of the present invention.

In the present example, the conveying motor 602 is a DC motor. When a target speed is given, the conveying motor 602 is subjected to acceleration control by increasing (accelerating) the speed of the conveying motor 602 at a constant rate so that the speed reaches a target value (constant speed). Subsequently, at a deceleration start position calculated based on the target speed and a target stop position, the conveying motor 602 starts to be subjected to deceleration control such that the speed of the conveying motor 602 decreases (decelerates) at a constant rate. FIG. 12 is a diagram illustrating a variation in the speed of the conveying motor 602 in the above-described basic control (PID control). The axis of abscissas indicates time, and the axis of ordinate indicates speed.

Figure 13:
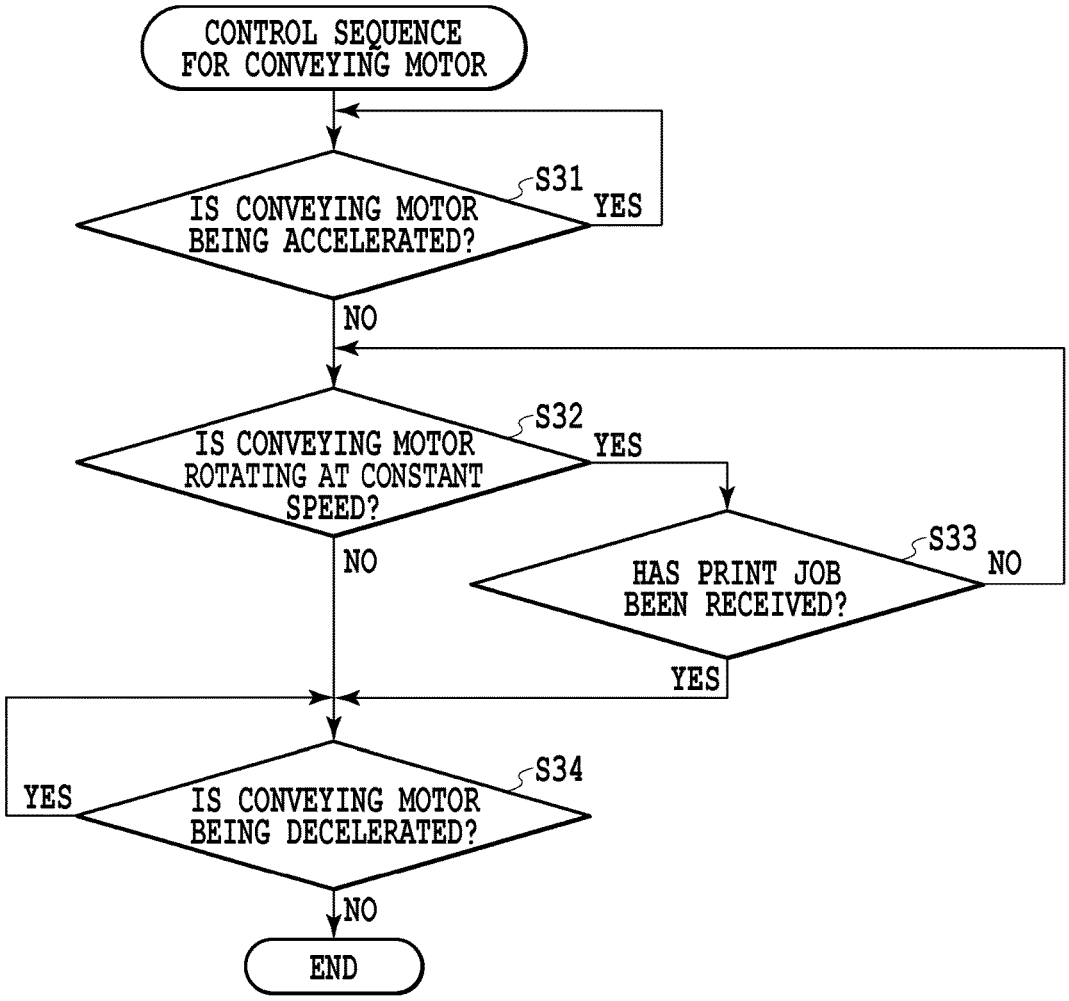
FIG. 13 is a flowchart illustrating a control sequence for the conveying motor according to the second embodiment of the present invention.

The CPU 1103 controls the conveying motor 602 in accordance with a control sequence in FIG. 13.

First, the CPU 1103 determines whether or not the speed of the conveying motor 602 is in an acceleration region in which the speed increases at a constant rate (step S31). Specifically, the CPU 1103 determines whether or not the speed of the conveying motor 602 has reached the target value. If the speed has not reached the target value, the CPU 1103 periodically performs the acceleration control for acceleration of the conveying motor 602 as described above, and repeats the determination in step S31. The periodic control (PID control) of the conveying motor 602 is performed not only during the acceleration control but also during constant-speed control and deceleration control. When the conveying motor 602 reaches the target speed, the CPU 1103 shifts to the constant-speed control for maintenance of the target speed. Then, the CPU 1103 determines whether or not the conveying motor 602 is rotating at the constant speed (step S32). If the conveying motor 602 is rotating at the constant speed, the CPU 1103 further determines whether or not a print job is being received (step S33). If a print job is being received, the CPU 1103 shifts to the deceleration control under which the speed of the conveying motor 602 is reduced at a constant rate as is the case where the conveying motor 602 has reached the deceleration start position. Then, the CPU 1103 determines whether or not the conveying motor 602 is decelerating (step S34). When the conveying motor 602 reaches the target stop position and stops, the CPU 1103 ends the deceleration controls and the sequence. In the present example, the CPU 1103 determines, only during the constant-speed control, whether or not a print job has been received. However, of course, the CPU 1103 can also determine, during the acceleration control and deceleration control, whether or not a print job has been received, and if a print job has been received, quickly stop the conveying motor 602.

Figure 14:
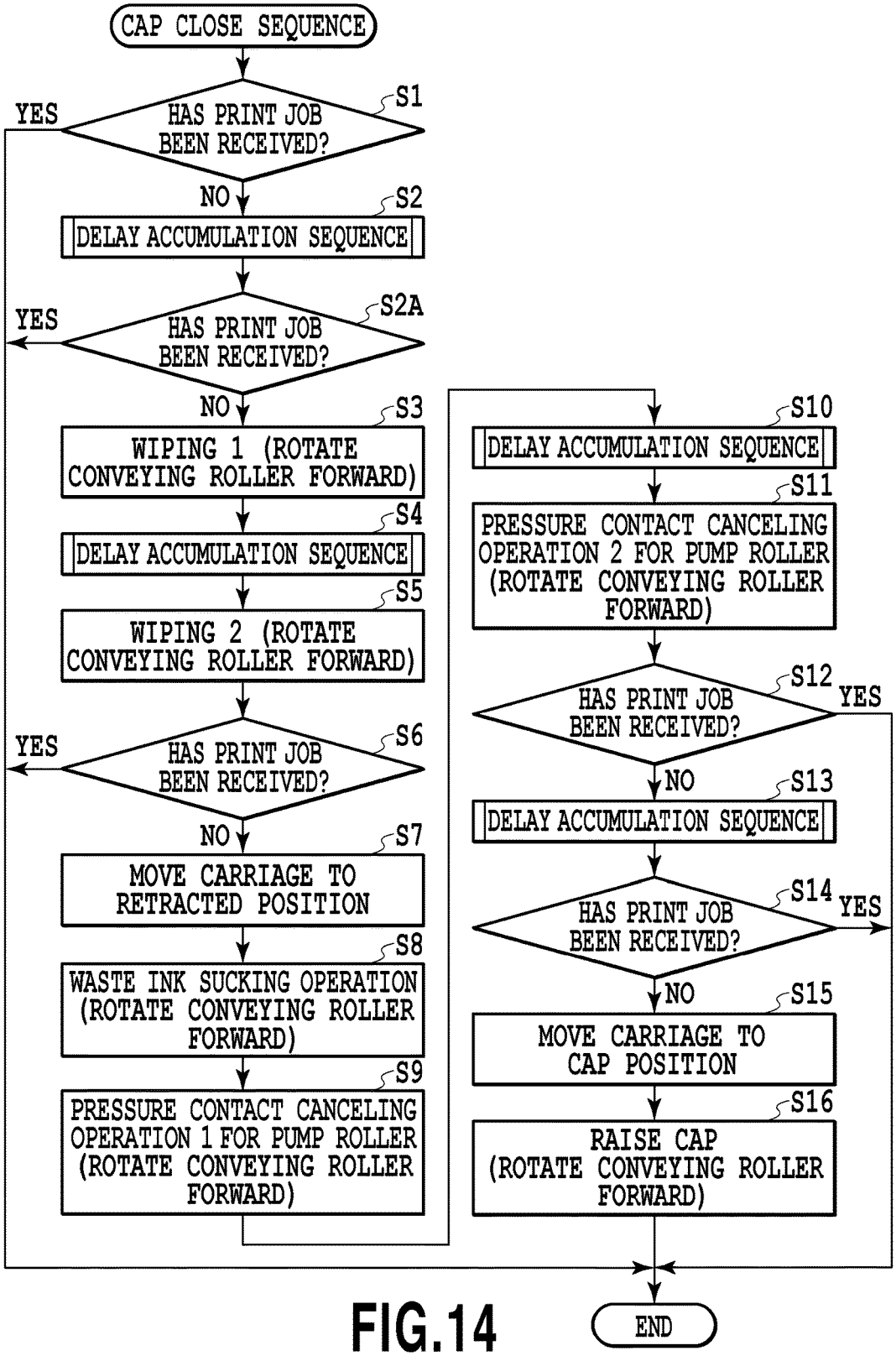
FIG. 14 is a flowchart illustrating a cap close sequence according to the second embodiment of the present invention.

The CPU 1103 executes the cap close sequence in accordance with a flowchart in FIG. 14. Compared to the cap close sequence in FIG. 10 according to the first embodiment, the cap close sequence according to the second embodiment includes, between step S2 and step S3, additional step S2A for determining whether or not a print job has been received. This is intended to also determine whether or not a print job has been received while the conveying roller 9 is rotating backward during the delay accumulation sequence. The cap close sequence is suspended if a print job is received during the delay accumulation sequence. The cap close sequence is similarly suspended when a print job is received during the delay accumulation sequence in step S13. In contrast, when a pint job is received during the cap close sequence in step S10, the recovery cam 507 is not in the standby position in spite of an attempt to suspend the cap close sequence. Thus, the CPU 1103 performs the pressure contact cancelling operation 2 for the pump roller (step S11) to move the recovery cam 507 to the standby position. The CPU 1103 then confirms that a print job has already been received, and suspends the cap close sequence (step S12).

As described above, according to the second embodiment, whether or not a print job has been received is also periodically determined while the conveying motor is being driven during the delay accumulation sequence in the cap close sequence. If a print job has been received, the conveying motor is quickly stopped. In other words, when a print job is received during a recovery operation for the print head, the recovery operation is suspended and the print job is quickly performed on the condition that the recovery cam 507 is in the standby position, which permits the print job to be performed. Subsequently, the cap close sequence is ended. Thus, when a print job is received during the delay accumulation sequence, suspension of the cap close sequence and subsequent start of a printing operation can be carried out earlier.

Other Embodiments

The printing scheme is not limited to a serial scan scheme involving reciprocation of the print head and conveyance of sheets but may be a full line scheme in which sheets are consecutively conveyed to the print head. Furthermore, the print head may be any print head that can apply ink to sheets and is not limited to the ink jet print head. The recovery operation may be any operation of keeping the print head able to appropriately apply ink.

Furthermore, the movable discharge tray is not limited to the type that is opened and closed based on rotation but may be of an extendible type. The discharge tray may be any discharge tray that can move to a holding position where sheets can be held in the discharge tray.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-168321, filed Aug. 13, 2013, which is hereby incorporated by reference herein in its entirety.

What is claimed is:

1. A printing apparatus comprising:

a print head configured to perform a printing operation for printing an image on a sheet;

a drive source configured to rotate in a first direction and a second direction, the second direction being opposite to the first direction;

a discharge roller configured to discharge the sheet printed by the print head when the drive source rotates in the first direction;

a discharge tray configured to be opened and closed with respect to the printing apparatus, the discharge tray being opened in a case where a rotation amount of the drive source in the first direction is equal to or larger than a predetermined rotation amount;

a recovery unit configured to be driven by rotation of the drive source in the first direction so as to perform a recovery operation for recovering the print head, the recovery unit being moveable, during the recovery operation, to a first position for allowing performance of the printing operation and a second position for not allowing performance of the printing operation; and a control unit configured to rotate the drive source in the second direction so as to inhibit the drive source from rotating a rotation amount in the first direction that is equal to or larger than the predetermined rotation amount during the recovery operation;

wherein, in a case where the recovery unit is in the first position, the control unit determines whether a particular job has been received, and in a case where the recovery unit is in the second position, the control unit does not determine whether a particular job has been received, wherein, in a case where the control unit determines that the particular job has been received, the control unit suspends the recovery operation and executes the particular job.

2. The printing apparatus according to claim 1, wherein the particular job is at least one of a print job in which the image is printed on the sheet using ink ejected by the print head, a job in which a replaceable consumable component provided in the printing apparatus is replaced, and a cleaning job in which a component provided in the printing apparatus is cleaned.

3. The printing apparatus according to claim 1, wherein the recovery unit performs the recovery operation using a drive force of the drive source utilized to rotate the discharge roller in the first direction.

4. The printing apparatus according to claim 1, wherein the recovery operation includes at least one of a wiping operation for wiping the print head, a movement of a carriage lock pin for regulating a position of a carriage on which the print head is mounted, and a movement of the cap.

5. The printing apparatus according to claim 1, wherein the control unit rotates the drive source in the second direction in a state where a drive force of the drive source is not transmitted to the recovery unit.

6. A method for controlling a printing apparatus, the printing apparatus having a print head configured to perform a printing operation for printing an image on a sheet, a drive source configured to rotate in a first direction and a second direction opposite to the first direction, a discharge roller configured to discharge the sheet printed by the print head when the drive source rotates in the first direction, a discharge tray configured to be opened and closed with respect to the printing apparatus, the discharge tray being opened in a case where a rotation amount of the drive source in the first direction is equal to or larger than a predetermined rotation amount, and a recovery unit configured to be driven by rotation of the drive source in the first direction so as to perform a recovery operation for recovering the print head, the recovery unit being moveable, during the recovery operation, to a first position for allowing performance of the printing operation and a second position for not allowing performance of the printing operation, the method comprising the steps of:

rotating the drive source in the first direction to perform the recovery operation;

rotating the drive source in the second direction so as to inhibit the drive source from rotating a rotation amount in the first direction that is equal to or larger than the predetermined rotation amount;

determining, during the recovery operation, whether or not a particular job has been received in a case where the recovery unit is in the first position, and not determining whether or not the particular job has been received in a case where the recovery unit is in the second position; and suspending the recovery operation in a case where it is determined that the particular job has been received.

7. A method for controlling a printing apparatus, the method comprising the steps of:

rotating a drive source in a first direction to perform a recovery operation for recovering a print head with a recovery unit, the recovery unit being moveable, during the recovery operation, to a first position for allowing performance of a printing operation and a second position for not allowing performance of the printing operation;

rotating the drive source in a second direction so as to inhibit the drive source from rotating a rotation amount in the first direction that is equal to or larger than a predetermined rotation amount, the second direction being opposite to the first direction;

determining, during the recovery operation, whether or not a particular job has been received in a case where the recovery unit is in the first position, and not determining whether or not the particular job has been received in a case where the recovery unit is in the second position; and suspending the recovery operation in a case where it is determined that the particular job has been received.

* * * * *